United States Patent [19]

Crist

[11] 4,240,386

[45] Dec. 23, 1980

[54] VARIABLE STROKE ENGINE OR COMPRESSOR

[76] Inventor: Oliver Crist, 342 Skyline Dr., Vista, Calif. 92083

[21] Appl. No.: 17,562

[22] Filed: Mar. 5, 1979

[51] Int. Cl.[3] ..... F02B 75/04; F02B 75/36

[52] U.S. Cl. ..... 123/48 B; 92/60.5; 123/48 R; 417/274

[58] Field of Search ..... 92/60.5, 13; 417/274; 123/48 B, 48 R

[56] References Cited

U.S. PATENT DOCUMENTS

| | | | |
|---|---|---|---|
| 2,029,169 | 1/1936 | Hironaka | 123/48 B |
| 2,569,559 | 10/1951 | Devillers | 123/48 B |
| 2,865,350 | 12/1958 | Biermann | 123/48 B |
| 2,873,611 | 2/1959 | Biermann | 123/48 B |

FOREIGN PATENT DOCUMENTS

| | | | |
|---|---|---|---|
| 404223 | 10/1909 | France | 123/48 |
| 18728 | of 1900 | United Kingdom | 123/48 |
| 476371 | 12/1937 | United Kingdom | 123/48 |

*Primary Examiner*—Wendell E. Burns
*Attorney, Agent, or Firm*—Richard L. Miller

[57] ABSTRACT

A unique drive for an engine or compressor piston, including an angularly inclined piston wrist pin, an inclined throw along a crankshaft, a piston connecting rod therebetween being additionally slidable along the axes of the wrist pin and throw at each rotation of the crankshaft, and a guide and shift device for sliding the connecting rod for long or short strokes, the device being slideable transversely through an engine cylinder.

4 Claims, 2 Drawing Figures

VARIABLE STROKE ENGINE OR COMPRESSOR

BACKGROUND OF THE INVENTION

This invention relates generally to internal combustion engines.

It is well known that in a conventional internal combustion engine, a piston stroke is transmitted to a crackshaft by means of a piston connecting rod therebetween, opposite ends of the connecting rod being pivotally attached to a transverse piston pin and to a crankshaft throw arm pin, the pins being axially parallel to each other while transverse (or perpendicular) to the connecting rod movement and piston stroke.

SUMMARY OF THE INVENTION

A principal object of the present invention is to provide an engine piston drive wherein the pins of the piston and the crankshaft throw arm are both angularly inclined respective to a transverse plane of the piston and the longitudinal axis of the crankshaft, and wherein the connecting rod is additionally slideably controlled along the axes of the piston pin and the crankshaft throw arm pin, so as to selectively vary the length of the stroke, as wished.

Another object is to provide a piston drive wherein a stroke may be lengthened as a load is applied on the engine.

Another object is to provide a piston drive wherein a short or long stroke have a same compression ration.

Still another object is to provide a piston drive which aids in saving fuel energy in running an engine.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF PREFERRED EMBODIMENT

Figures 1, 2:
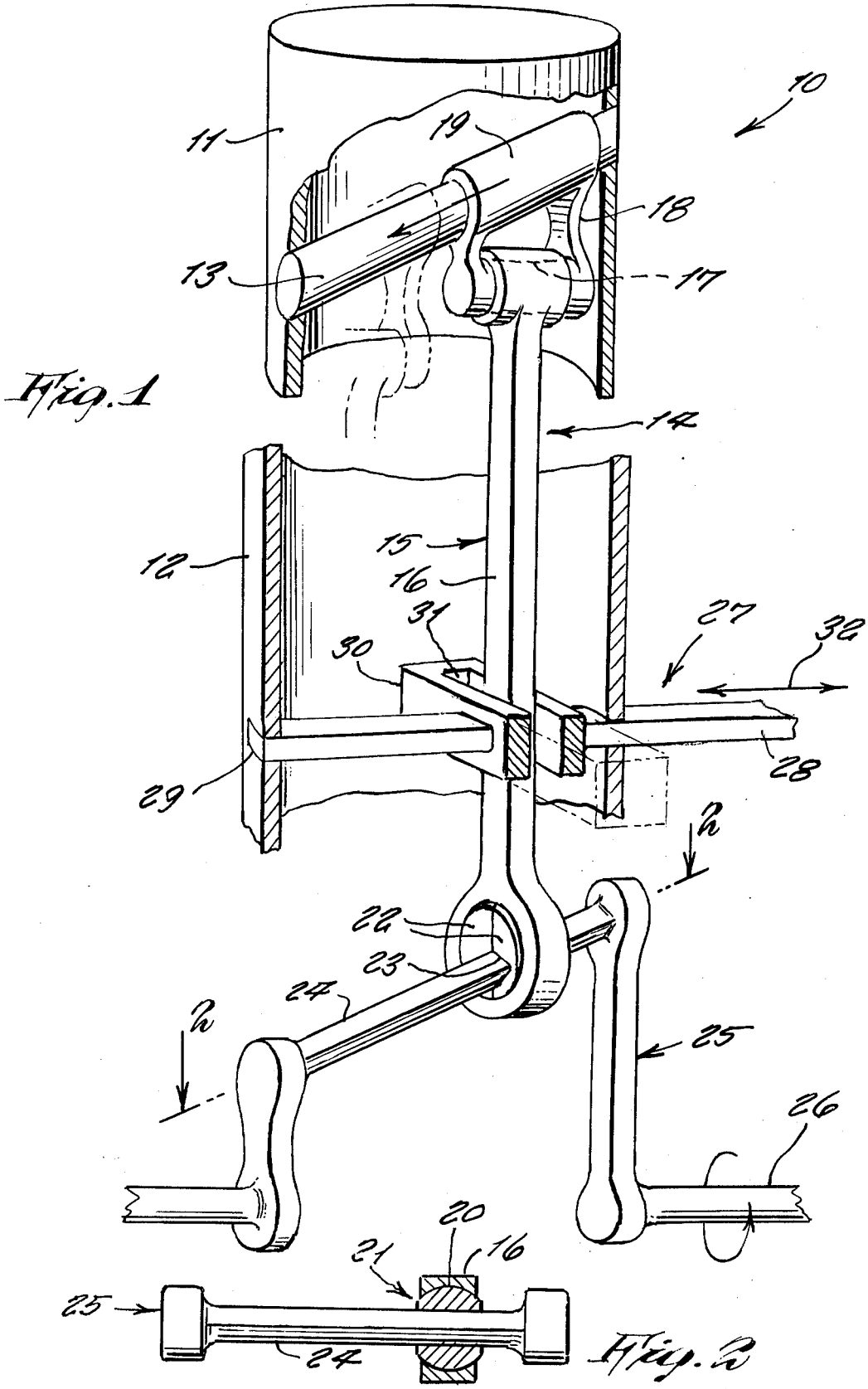
FIG. 1 is a cross-sectional perspective view of an engine or compressor cylinder, showing the invention.
FIG. 2 is a top view of the crankshaft throw arm, as viewed on line 2—2 of FIG. 1.

Referring now to the drawing in greater detail, the reference numeral 10 represents a piston drive according to the present invention wherein there is a piston 11 slideable in a cylinder 12 of an internal combustion engine or compressor. In the present invention, a wrist pin 13 is mounted angularly inclined within the piston, and a connecting rod assembly 14 is pivotally mounted thereupon.

The connecting rod assembly includes a connect-rod 15 having a straight shank 16 that is cross-sectionally rectangular in shape, an upper end of which has a transverse bearing opening 17 in which is pivotally supported a link 18 having a bearing opening 19 receiving the wrist pin. The opening 19 is correspondingly angularly inclined similarly to the wrist pin. An opposite end of the shank has a spherical opening 20 in which a ball 21 is rotatable, and which is comprised of two sections 22, A square-shaped opening 23 formed at the center of the adjacent sections slideably receives a square shaft 24 of a throw arm 25 formed on crankshaft 26. The opening 23 is angularly inclined, similarly to openings 19, and at a same angle, so that the connecting rod assembly is slideable sidewardly thereon.

The present invention includes a shift mechanism 27 for sliding the connecting rod assembly sidewardly a controlled distance for either longer or shorter strokes. The shift mechanism includes a square bar 28 slideable transversely through the cylinder 12 in bearing openings 29, the bar having a transversely wide frame 30 forged integrally therewith, which has a sidewardly slot 31 therethrough in which the connecting rod shank 16 is slideable.

In operative use, when the bar 28 is sidewardly shifted, as indicated by double-headed arrow 32, the connecting rod assembly is thus shifted for stroke length operation, as preferred.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A variable stroke piston drive, comprising in combination, a cylinder, a piston slideable in said cylinder, a wrist pin in said piston, said wrist pin extending angularly inclined respective to a stroke direction of said piston; said drive also including a crankshaft, a throw arm on said crankshaft, a shaft on an outer end of said throw arm, said shaft being angularly inclined respective to a rotational axis of said crankshaft; a connecting rod assembly between said wrist pin and said throw arm shaft; and a shift mechanism for sliding said connecting rod assembly laterally along said wrist pin and said throw arm shaft, said mechanism comprising a bar slideable transversely through said piston, a frame formed along an intermediate portion of said bar, a slot in said frame extending transversely to said bar, and said connecting rod assembly extending through said slot.

2. The comgination as set forth in claim 1 where said connecting rod assembly comprises a connecting rod and a link pivotally secured to an upper end thereof.

3. The combination as set forth in claim 2 wherein said link includes a bearing opening for said wrist pin, said bearing opening being at an inclined angle.

4. The combination as set forth in claim 3 wherein a lower end of said connecting rod has a bearing opening receiving said crankshaft throw arm shaft, and means in said connecting rod opening for grasping said throw arm shaft during rotation of said throw-arm shaft about a longitudinal axis of said crankshaft.

* * * * *